US005733697A

United States Patent [19]

Endoh et al.

[11] Patent Number: 5,733,697

[45] Date of Patent: Mar. 31, 1998

[54] PHOTORECEPTOR FOR ELECTROPHOTOGRAPHY

[75] Inventors: Hiroyuki Endoh; Akira Hirano, both of Tokyo, Japan

[73] Assignee: NEC Corporation, Tokyo, Japan

[21] Appl. No.: 806,858

[22] Filed: Feb. 26, 1997

[30] Foreign Application Priority Data

Feb. 28, 1996 [JP] Japan ..... 8-40220
Jan. 10, 1997 [JP] Japan ..... 9-002844

[51] Int. Cl.[6] ..... G03G 5/047

[52] U.S. Cl. ..... 430/59; 430/83

[58] Field of Search ..... 430/59, 83

[56] References Cited

U.S. PATENT DOCUMENTS

| | | | |
|---|---|---|---|
| 3,820,989 | 6/1974 | Rule et al. | 430/73 |
| 5,077,163 | 12/1991 | Hayata et al. | 430/59 |
| 5,486,441 | 1/1996 | Matsushima et al. | 430/59 |

FOREIGN PATENT DOCUMENTS

| | | | |
|---|---|---|---|
| 58-65440 | 4/1983 | Japan . | |
| 1-281453 | 11/1989 | Japan | 430/59 |
| 3-64760 | 3/1991 | Japan | 430/59 |
| 3-94259 | 4/1991 | Japan | 430/59 |

*Primary Examiner*—Roland Martin
*Attorney, Agent, or Firm*—Sughrue, Mion, Zinn, MacPeak & Seas, PLLC

[57] ABSTRACT

A photoreceptor for electrophotography exhibits high photosensitivity and provides excellent potential stability and durability upon repeated use. The photoreceptor for electrophotography contains, as a charge-transport material, a triphenylamine derivative represented by the following formula (1) or (2) or the mixture thereof:

(1)

(2)

wherein each of $Ar^1$ through $Ar^{10}$ is a phenyl group which may or may not have a substituent, and the substituent on any of the groups $Ar^1$ through $Ar^{10}$ is a group or an atom selected from the group consisting of C1–C4 alkyl, C1–C4 alkoxy, C1–C4 alkylamino, C1–C4 dialkylamino, C1–C4 alkylthio, C1–C4 halogenoalkyl, amino, and a halogen atom; each of $R^1$ through $R^{10}$ represents a hydrogen atom or a methyl group; each of $R^{11}$ through $R^{15}$ represents a hydrogen atom, a C1–C4 alkyl group, a C6–C14 aryl group, or a C7–C14 aralkyl group, wherein the substitutents $R^{11}$ through $R^{15}$ may be identical to or different from one another.

8 Claims, 2 Drawing Sheets

PHOTORECEPTOR FOR ELECTROPHOTOGRAPHY

BACKGROUND OF THE INVENTION (a) Field of the Invention

The present invention relates to a photoreceptor for electrophotography and, more particularly, to a photoreceptor for electrophotography comprising a photosensitive layer containing both a charge-generation material and a charge-transport material.

(b) Description of the Related Art

Photoconductive materials for use in photoreceptors that are used in electrophotography include a variety of inorganic materials such as selenium (Se), cadmium sulfide (CdS), zinc sulfide (ZnS), and amorphous silicon (a—Si). These inorganic materials have a number of advantages, yet they still have disadvantages in that they are hazardous to human health and to the environment, disposal of their waste is restricted, and they are expensive. Therefore, in recent years, many photoreceptors incorporating organic material which are free from the above-mentioned disadvantages have been proposed and put to practical use. There are two types of photoreceptors: function-partitioned photoreceptors in which a material that generates charged carriers (hereinafter referred to as charge-generation material) and a material that receives and transports the generated charged carriers (hereinafter referred to as charge-transport material) are respectively incorporated into separate layers, and single-layer photoreceptors in which generation of charges and transportation of charges are performed in a single common layer. Function-partitioned photoreceptors are more favored as they allow a broad range of material selection and can be made to have elevated sensitivity.

Charge-transport material may be photoconductive polymers such as polyvinylcarbazole, or may be low-molecular photoconductive compounds that are dispersed and dissolved in a binder polymer. Since photoconductive polymers exhibit insufficient film-forming properties and poor adhesion when used alone, additives such as plasticizers and binder polymers are incorporated thereto so as to eliminate these drawbacks. However, incorporation of these materials is problematic in practical use since it sometimes reduces sensitivity and increases the level of residual potential.

On the other hand, when binder polymers are properly selected, low-molecular photoconductive compounds facilitate provision of photoreceptors having excellent mechanical properties. However, these compounds are not satisfactory in terms of their sensitivity. For example, diaryl alkane derivatives described in U.S. Pat. No. 3,820,989 have poor stability against light, although they have no particular problems with regard to compatibility with binder polymers. Therefore, if diaryl alkane derivatives are used in photosensitive layers of a photoreceptor for electrophotography in which charging with electricity and exposure to light are repeatedly performed, there arises a problem in that sensitivity of the photoreceptor gradually diminishes upon repeated use. The stilbene compounds described in Patent Publication No. JP-A-58-65440 have relatively good retentivity of charge, sensitivity, etc. However, they are not satisfactory in terms of stability after repeated use.

The monostyryl triphenylamine compounds described in Patent Publication No. JP-B-63-019867, distyryl triphenylamine compounds described in Patent Publication No. JP-B-05-042661 and No. JP-A-62-120346, and tristyryl triphenylamine compounds described in Patent Publication No. JP-B-06-093124 and No. JP-A-63-163361 are excellent in terms of retentivity of charge, sensitivity, and stability after repeated use. However, charge mobility of those compounds still need to be improved; therefore, they are not satisfactory as charge-transport material to be used with photoreceptors for high-speed electrophotography.

Chemical formulae (101) through (103) shown below represent typical examples of compounds described in the above-mentioned publications. Each of the compounds of formulae (101) through (103) contains only one triphenylamine moiety (formula (201)) which serves as a hopping site for charges in one molecule. Therefore, sufficient charge mobility cannot be obtained, and as a result photosensitivity is insufficient. These publications describe that a variety of substituents may be introduced into these compounds. However, introduction of a plurality of triphenylamine moieties is not shown. Patent Publication No. JP-B-07-013741 discloses a photoreceptor for electrophotography in which a plurality of compounds each having the above-mentioned triphenylamine moiety are incorporated in combination. However, according to that publication, each of the compounds to be incorporated contains only one triphenylamine moiety, and no compounds are shown in which a plurality of triphenylamine moieties are contained in a single compound.

(101)

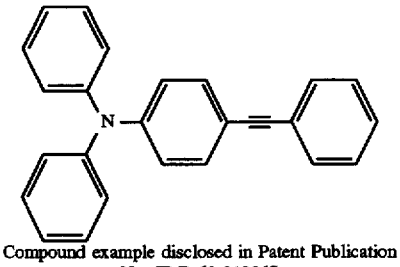

Compound example disclosed in Patent Publication No. JP-B-63-019867

(102)

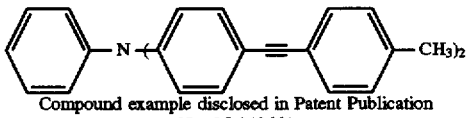

Compound example disclosed in Patent Publication No. 05-042661

(103)

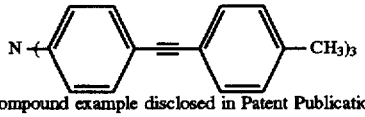

Compound example disclosed in Patent Publication No. 06-093124

(201)

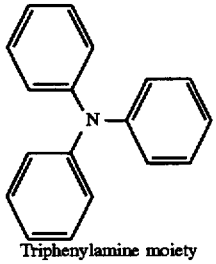

Triphenylamine moiety

Thus, the conventional compounds referred to hereinabove have their own shortcomings in photosensitivity at a low electric potential.

SUMMARY OF THE INVENTION

In view of the above, it is an object of the present invention to provide a photoreceptor for electrophotography which has excellent photosensitive properties and exhibits excellent potential stability upon repeated use, making use of a charge-transport material composed of a novel organic photoconductive material.

In accordance with the present invention, there is provided a photoreceptor for electrophotography comprising a photosensitive layer containing at least one compound selected from the compounds of formula (1) or at least one compound selected from the compounds of formula (2); or alternatively, comprising a photosensitive layer containing a mixture of at least one compound selected from the compounds of formula (1) and at least one compound selected from the compounds of formula (2):

(1)

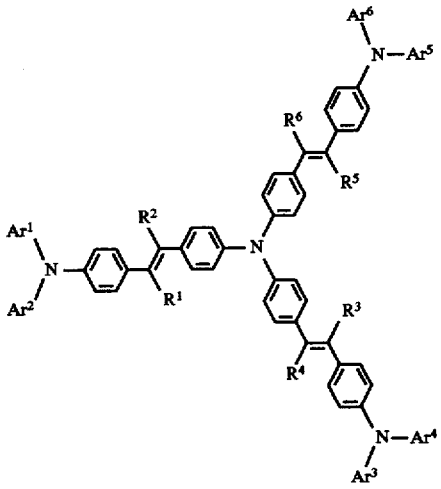

(2)

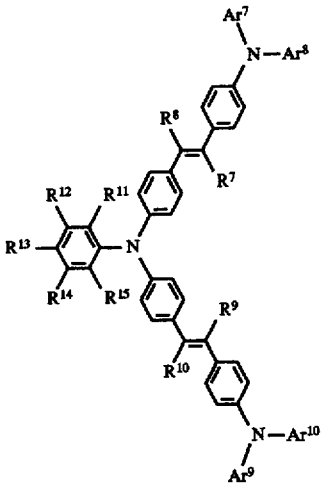

wherein each of $Ar^1$ through $Ar^{10}$ is a phenyl group which may or may not have a substituent, and the substituent on any of the groups $Ar^1$ through $Ar^{10}$ is a group or an atom selected from the group consisting of C1–C4 alkyl, C1–C4 alkoxy, C1–C4 alkylamino, C1–C4 dialkylamino, C1–C4 alkylthio, C1–C4 halogenoalkyl, amino, and a halogen atom; each of $R^1$ through $R^{10}$ represents a hydrogen atom or a methyl group; each of $R^{11}$ through $R^{15}$ represents a hydrogen atom, a C1–C4 alkyl group (such as methyl, ethyl, propyl, or butyl), a C6–C14 aryl group (such as phenyl or naphthyl), or a C7–C14 aralkyl group (such as benzyl or phenylethyl), wherein the substitutents $R^{11}$ through $R^{15}$ may be identical to or different from one another.

DESCRIPTION OF THE PREFERRED EMBODIMENTS

Figure 1:
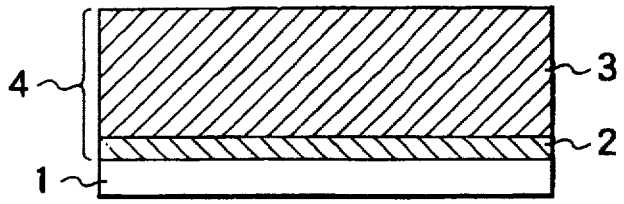
FIG. 1 is a sectional view of a first embodiment of the present invention.

In the above-described formulae (1) and (2), each of the phenyl groups, $Ar^1$ through $Ar^{10}$, may have one or more of the above-described substituents. Examples of the alkyl group include methyl, ethyl, propyl, isopropyl, and butyl. Examples of the alkoxy group include methoxy, ethoxy, and propoxy. Examples of the alkylamino group include methylamino and ethylamino. Examples of the dialkylamino group include dimethylamino and diethylamino. Examples of the alkylthio group include methylthio, and ethylthio. Examples of the halogenoalkyl group include trifluoromethyl, trichloromethyl, and pentafluoroethyl. Examples of the halogen atom include chlorine and bromine. When a plurality of substituents are contained, they may be identical to or different from one another.

A charge-transport material has a hopping site for charges in each molecule thereof. Charges are transported while traveling from a hopping site to another hopping site, so that the material thereby exhibits properties as a photosensitive material for electrophotography. In obtaining excellent charge-transport properties, efficiency of charge transportation is an important factor. The charge-transport material of the present invention is characterized by, in one molecule thereof, 3 or 4 triphenylamine moieties which serve as hopping sites for charges so as to obtain excellent charge-transport characteristics. The presence of a plurality of hopping sites in the molecule provides remarkably excellent electrophotographic characteristics. Moreover, any of the charge-transport compounds represented by formula (1) and (2) of the present invention, regardless of whether it is used alone or in combination, exhibits excellent electrophotographic characteristics.

The compounds represented by formulae (1) and (2) may be synthesized according to known methods. For example, they may be obtained by subjecting an aldehyde derivative or a ketone derivative represented by the following formulae:

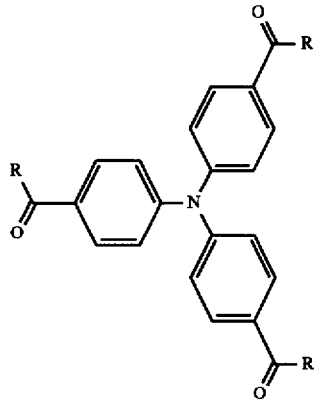

or

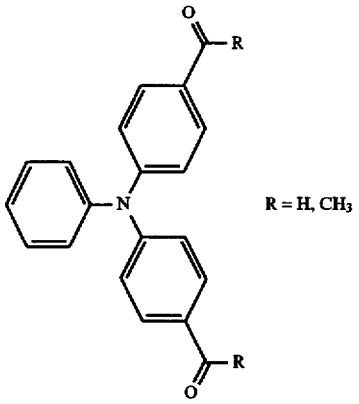

and a phosphorous ester derivative represented by the following formula:

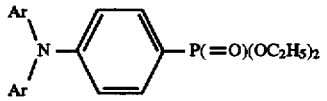

to a condensation reaction through use of a Wittig reaction.

Examples of the compounds represented by formulae (1) and (2) in the present invention are shown in Tables 1 through 6 and Tables 7 through 10, respectively. However, the listed compounds should not be construed as limiting the invention.

In the present invention, any of the compounds of formulae (1) and (2) and any mixture of these compounds are soluble in tetrahydrofuran, chloroform, dichloromethane, dichloroethane, toluene, and like solvents. One or more compounds of the invention are dissolved in or dispersed in a binder resin, and the resultant liquid is applied onto a substrate to thereby obtain a hard film having an enhanced mechanical strength. Therefore, the compounds of the present invention are useful as charge-transport materials for use in photoreceptors for electrophotography. Preferably, the photoreceptor for electrophotography according to the present invention has a multilayer structure in which an undercoat layer, a charge-generation layer, and a charge-transport layer are laminated, in this order, on a conductive substrate. The order of the layers may be changed such that on a conductive substrate is placed an undercoat layer, a charge-transport layer, and a charge-generation layer, in this order. Alternatively, a charge-generation material and a charge-transport material may be dispersed in a suitable resin and the resultant dispersion may be coated onto an undercoat layer. Also, the undercoat layer may be omitted if unnecessary. Moreover, an overcoat layer may be provided as an outermost layer.

When the compound(s) of the present invention is used as a charge-transport material and is applied to a substrate together with a suitable binder, it is possible to obtain a charge-transport layer having excellent photosensitivity, reduced residual potential and dark decay, and good stability upon repeated use.

Coating may be performed by use of any of conventional coating apparatus known as a spin coater, an applicator, a spray coater, a bar coater, an immersion coater, a doctor blade, a roller coater, a curtain coater, a bead coater, and a slide hopper. Drying is preferably performed by application of heat, and may be performed at a temperature from approximately 40 to 300 C., preferably from approximately 60 to 200 C., for about 2 minutes to 10 hours, preferably for about 10 minutes to 6 hours, under stationary or ventilated conditions.

A binder resin which may be used for forming a charge-transport layer by way of coating is selected from a wide range of insulating resins that are conventionally used. A binder resin may also be selected from organic photoconductive polymers such as polyvinylcarbazole resins, polyvinyl anthracene resins, and polyvinyl pyrene resins. Specific examples of such resins include, but are not limited to, a variety of insulating resins such as polyvinyl butyral resins, polyacrylate resins, polycarbonate resins, polyester resins, polyester carbonate resins, phenoxy resins, polyvinyl acetate resins, acrylic resins, polyacrylamide resins, polyamide resins, polyvinyl pyridine resins, cellulose resins, urethane resins, epoxy resins, silicone resins, polystyrene resins, polyether resins, polythioether resins, polyketone resins, polyvinyl chloride resins, vinyl chloride-vinyl acetate copolymer resins, polyvinyl acetal resins, polyacrylonitrile resins, phenol resins, melamin resins, casein, polyvinyl alcohol resins, polyvinylpyrrolidone resins, and polysilane resins. Preferably, the charge-transport layer contains a binder resin in an amount from approximately 0 to 99% by weight, preferably from approximately 30 to 80% by weight, with respect to the total weight of the layer. The binder resin, examples of which are listed above, may be used alone or in combinations of two or more.

Regarding the solvent for dissolving the charge-transport material, different solvents should be used in accordance with the type of the resin. Preferably, the solvent is selected from those that do not adversely affect the charge-transport layer and the undercoat layer which will be described below during application of the resin thereto. Specific examples of such a solvent for the charge-transport material include, but are not limited to: aromatic hydrocarbons such as benzene, toluene, xylene, ligroin, monochlorobenzene, and dichlorobenzene; ketones such as acetone, methyl ethyl ketone, and cyclohexanone; alcohols such as methanol, ethanol, and isopropyl alcohol, esters such as ethyl acetate and methyl cellosolve; aliphatic halogenated hydrocarbons such as carbon tetrachloride, chloroform, dichloromethane, dichloroethane, and trichloroethylene; ethers such as tetrahydrofuran and dioxane; amides such as N,N-dimethylformamide and N,N-dimethylacetamide; and sulfoxides such as dimethylsulfoxide.

The thickness of the charge-transport layer of the photoreceptor for electrophotography is preferably from approximately 5 to 50 microns (μm), and more preferably from approximately 10 to 30 microns. If necessary, the charge-transport layer may further contain additives that are generally used in the art; for example, UV absorbers, antioxidants, electron-attractive compounds, and plasticizers.

The charge-generation material which is used in the present invention is a known photo-generation material, examples of which include inorganic materials such as CdS, Se, ZnO, and a—Si, phthalocyanines having a metal atom such as Si, Ge, Co, Cu, Al, In, Ti, Pb, or V, non-metallic phthalocyanines, azo pigments, bisazo pigments, tris-azo pigments, multicyclicquinone pigments, and perinone pigments, and organic materials such as cyanine dyes and squalirium dyes. One of these materials may be used alone or as a mixture thereof.

Depending on the type of the binder resin employed, different solvents should be used for dissolving the charge-generation material. Preferably, the solvent is selected so as not to adversely affect the below-described undercoat layer during coating. Specific examples of such a solvent for the charge-generation material include, but are not limited to: aromatic hydrocarbons such as benzene, toluene, xylene, ligroin, monochlorobenzene, and dichlorobenzene; ketones such as acetone, methyl ethyl ketone, and cyclohexanone; alcohols such as methanol, ethanol, and isopropyl alcohol, esters such as ethyl acetate and methyl cellosolve; aliphatic halogenated hydrocarbons such as carbon tetrachloride, chloroform, dichloromethane, dichloroethane, and trichloroethylene; ethers such as tetrahydrofuran and dioxane; amides such as N,N-dimethylformamide and N,N-dimethylacetamide; and sulfoxides such as dimethylsulfoxide.

The thickness of the charge-generation layer of the photoreceptor for electrophotography is preferably from approximately 0.01 to 2 microns, more preferably from approximately 0.1 to 1 microns, so as to stably retain charges. If necessary, the charge-generation layer may further contain, in addition to a binder resin, additives that are generally used in the art; for example, plasticizers, electron-accepting compounds, and electron-donating compounds. Coating may be performed in a manner identical to that described for the aforementioned charge-transport layer.

Binder resins for the undercoat layer may be any type of resins that are conventionally used. Examples of such resins include alcohol-soluble polyamide resins such as nylon 6, nylon 66, nylon 11, nylon 610, copolymerized nylons, and alkoxymethylated nylon; casein; polyvinyl alcohol resins; ethylene-acrylic acid copolymer resins; vinyl chloride-vinyl acetate-maleic acid copolymer resins; epoxy resins; gelatin; polyurethane resins; polyvinyl butyral resins; and cellulose resins such as nitrocellulose and carboxymethylcellulose. One of these resins may be used alone or in a mixture thereof. If necessary, electron-accepting compounds or electron-donating compounds may be added. The undercoat layer may be formed in a manner similar to that described for the aforementioned charge-transport layer and the charge-generation layer. The thickness of the undercoat layer is preferably from approximately 0.01 to 20 microns, and more preferably from approximately 0.2 to 10 microns. If unnecessary, the undercoat layer may be omitted.

The photoreceptor for electrophotography according to the present invention is advantageously used not only in copying machines, printers, and facsimile machines, but also in electrophotography, photoelectric transducers such as solar batteries and electrolytic luminescence elements, photo transducers, and materials for optical disks.

Figure 2:
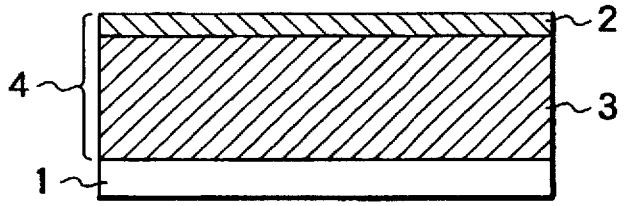
FIG. 2 is a sectional view of a second embodiment of the present invention.
Figure 3:
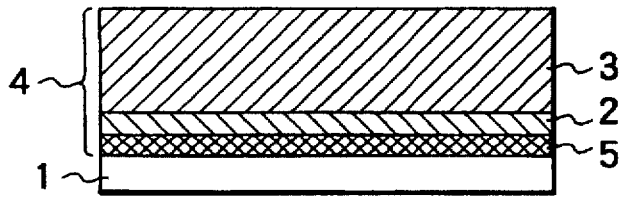
FIG. 3 is a sectional view of a third embodiment of the present invention.
Figure 4:
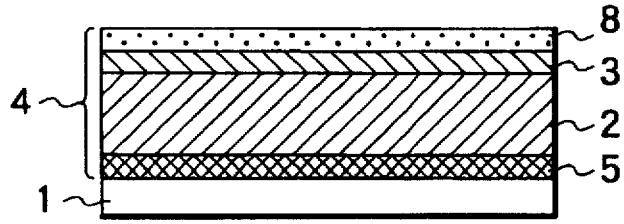
FIG. 4 is a sectional view of a fourth embodiment of the present invention.
Figure 5:
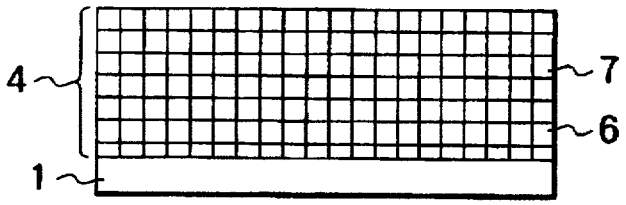
FIG. 5 is a sectional view of a fifth embodiment of the present invention.
Figure 6:
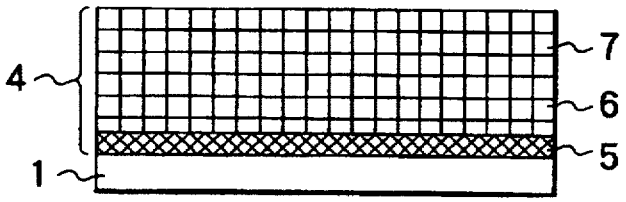
FIG. 6 is a sectional view of a sixth embodiment of the present invention.

A variety of structures are known for photoreceptors for electrophotography. The photoreceptor for electrophotography according to the present invention may have any one of conventionally known structures. Usually, the photoreceptor of the invention has a cross section as shown in FIGS. 1 through 6. In FIGS. 1 and 2, a photosensitive layer 4 is provided on a conductive support member 10 wherein the photosensitive layer 4 comprises a laminated structure of a charge-generation layer 2 containing as a primary component thereof a charge-generation material, and a charge-transport layer 3 containing as a primary component thereof a charge-transport material. The photosensitive layer 4 may be provided with an intervention of an undercoat layer 5 formed on the photoconductive support member (FIGS. 3 and 4). When the photosensitive layer 4 has a two-layer structure as illustrated in these drawings, the resultant photoreceptor exhibits the best electrophotographic characteristics. Alternatively, the photoreceptor of the present invention may include a photoconductive support member 1 and a photosensitive layer 4 which is provided on the support member 1 directly or with an intervention of an undercoat layer 5, wherein the photosensitive layer 4 contains a charge-generation material 7 dispersed in a layer 6 containing as a primary component thereof a charge-transport material (FIGS. 5 and 6). In addition, a protective layer 8 may be provided as an outermost layer (FIG. 4).

TABLE 1
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 1 | 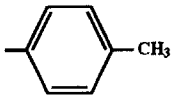 | 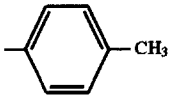 | 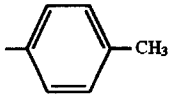 | 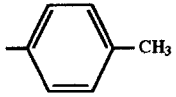 | 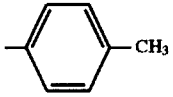 | 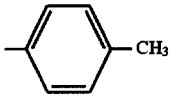 | H | H | H | H | H | H |
| 2 | 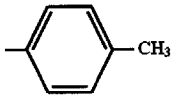 | 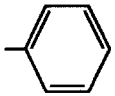 | 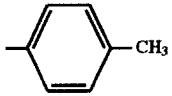 | 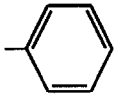 | 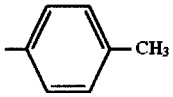 | 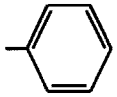 | H | H | H | H | H | H |
| 3 | 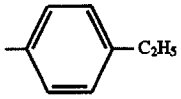 | 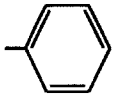 | 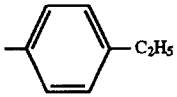 | 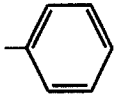 | 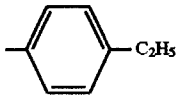 | 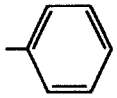 | H | H | H | H | H | H |
| 4 | 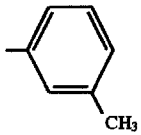 | 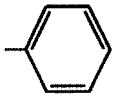 | 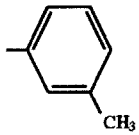 | 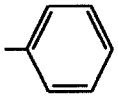 | 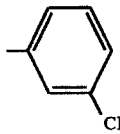 | 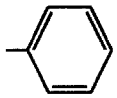 | H | H | H | H | H | H |
| 5 | 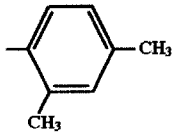 | 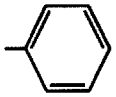 | 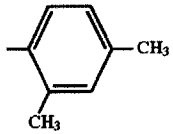 | 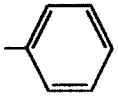 | 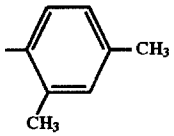 | 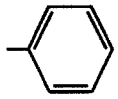 | H | H | H | H | H | H |
| 6 | 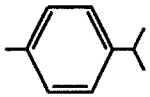 | 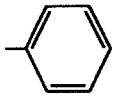 | 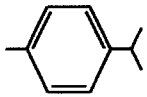 | 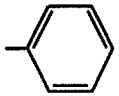 | 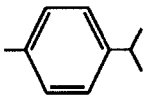 | 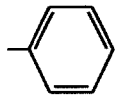 | H | H | H | H | H | H |
| 7 | 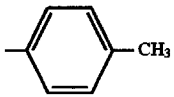 | 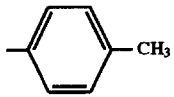 | 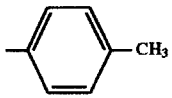 | 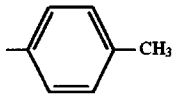 | 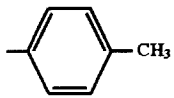 | 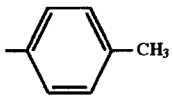 | H | $CH_3$ | H | $CH_3$ | H | $CH_3$ |
| 8 | 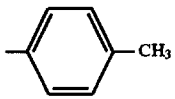 | 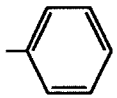 | 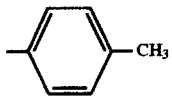 | 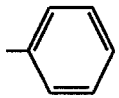 | 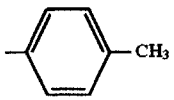 | 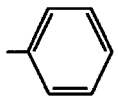 | H | $CH_3$ | H | $CH_3$ | H | $CH_3$ |

TABLE 2
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 9 | 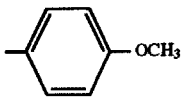 | 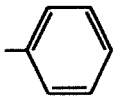 | 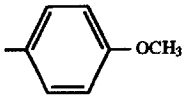 | 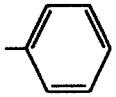 | 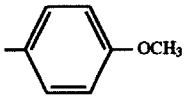 | 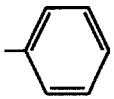 | H | H | H | H | H | H |
| 10 | 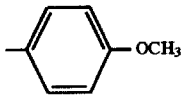 | 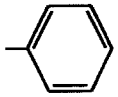 | 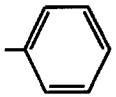 | 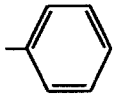 | 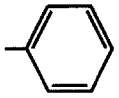 | 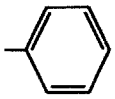 | H | H | H | H | H | H |
| 11 | 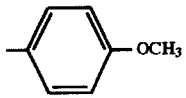 | 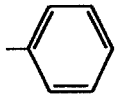 | 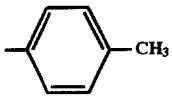 | 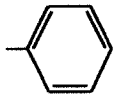 | 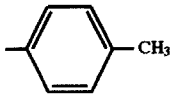 | 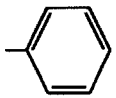 | H | H | H | H | H | H |
| 12 | 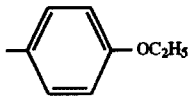 | 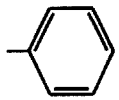 | 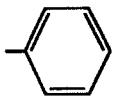 | 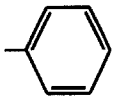 | 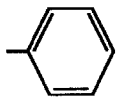 | 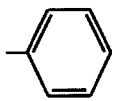 | H | H | H | H | H | H |
| 13 | 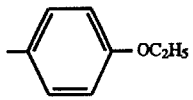 | 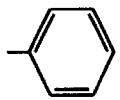 | 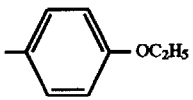 | 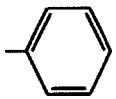 | 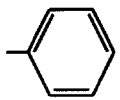 | 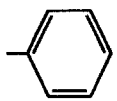 | H | H | H | H | H | H |
| 14 | 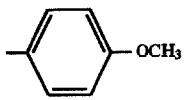 | 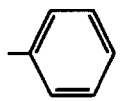 | 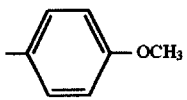 | 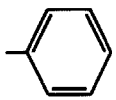 | 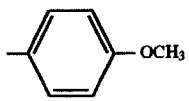 | 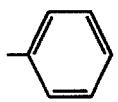 | H | $CH_3$ | H | $CH_3$ | H | $CH_3$ |
| 15 | 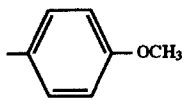 | 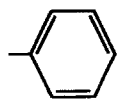 | 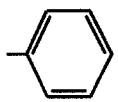 | 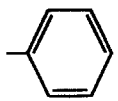 | 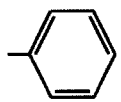 | 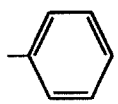 | H | $CH_3$ | H | $CH_3$ | H | $CH_3$ |
| 16 | 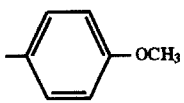 | 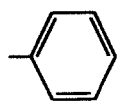 | 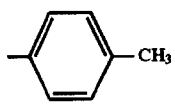 | 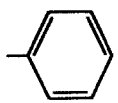 | 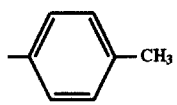 | 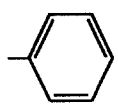 | H | $CH_3$ | H | $CH_3$ | H | $CH_3$ |

TABLE 3
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 17 | 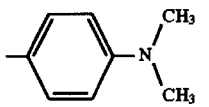 | 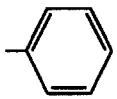 | 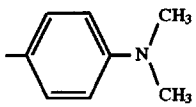 | 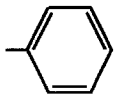 | 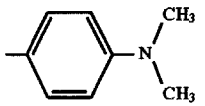 | 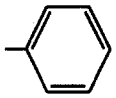 | H | H | H | H | H | H |
| 18 | 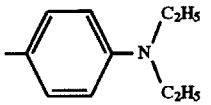 | 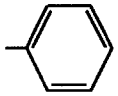 | 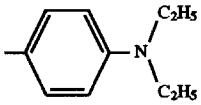 | 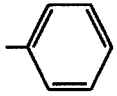 | 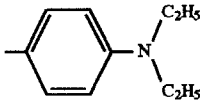 | 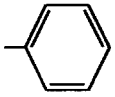 | H | H | H | H | H | H |
| 19 | 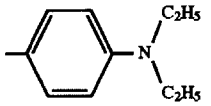 | 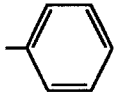 | 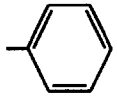 | 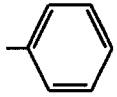 | 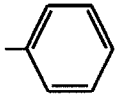 | 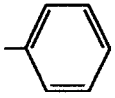 | H | H | H | H | H | H |
| 20 | 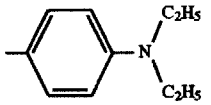 | 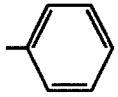 | 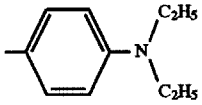 | 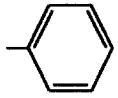 | 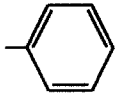 | 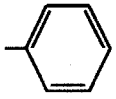 | H | H | H | H | H | H |
| 21 | 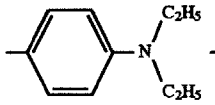 | 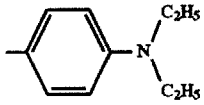 | 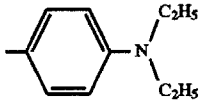 | 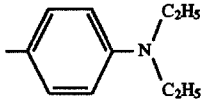 | 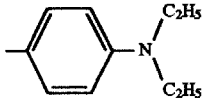 | 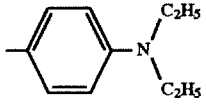 | H | H | H | H | H | H |
| 22 | 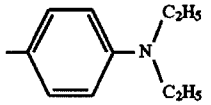 | 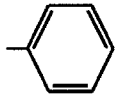 | 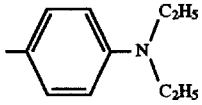 | 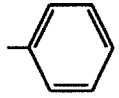 | 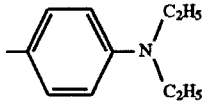 | 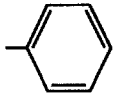 | H | $CH_3$ | H | $CH_3$ | H | $CH_3$ |
| 23 | 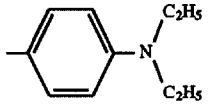 | 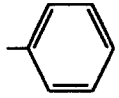 | 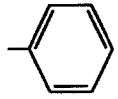 | 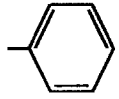 | 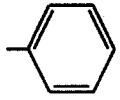 | 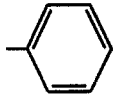 | H | $CH_3$ | H | $CH_3$ | H | $CH_3$ |
| 24 | 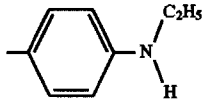 | 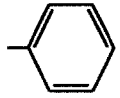 | 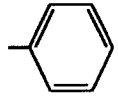 | 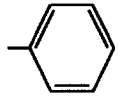 | 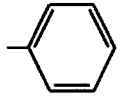 | 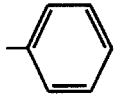 | H | $CH_3$ | H | $CH_3$ | H | $CH_3$ |

TABLE 4
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 25 | 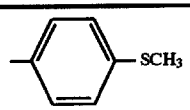 | 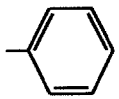 | 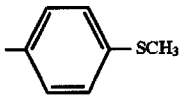 | 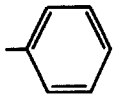 | 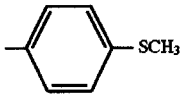 | 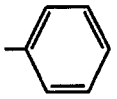 | H | H | H | H | H | H |
| 26 | 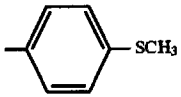 | 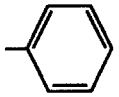 | 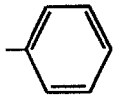 | 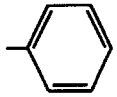 | 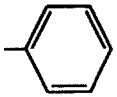 | 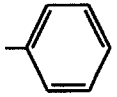 | H | H | H | H | H | H |
| 27 | 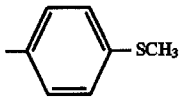 | 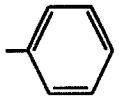 | 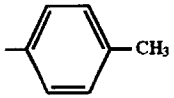 | 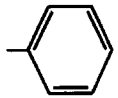 | 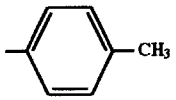 | 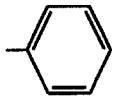 | H | $CH_3$ | H | $CH_3$ | H | $CH_3$ |
| 28 | 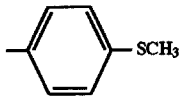 | 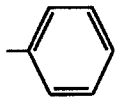 | 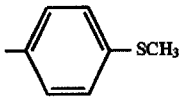 | 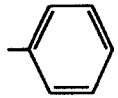 | 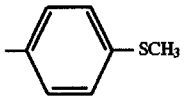 | 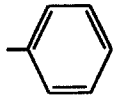 | H | H | H | H | H | H |
| 29 | 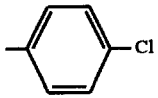 | 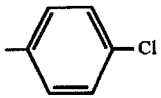 | 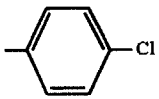 | 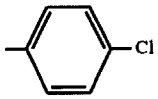 | 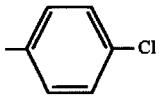 | 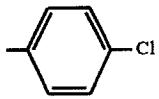 | H | H | H | H | H | H |
| 30 | 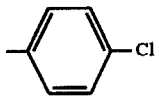 | 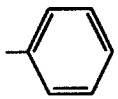 | 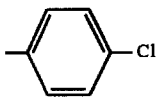 | 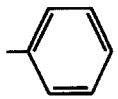 | 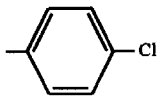 | 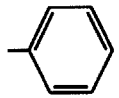 | H | H | H | H | H | H |
| 31 | 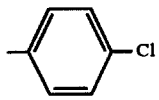 | 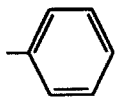 | 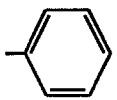 | 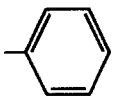 | 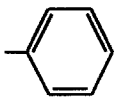 | 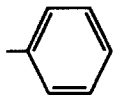 | H | H | H | H | H | H |
| 32 | 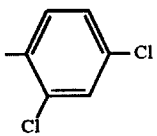 | 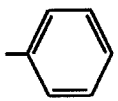 | 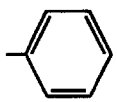 | 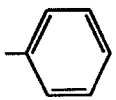 | 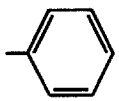 | 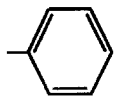 | H | H | H | H | H | H |

TABLE 5
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 33 | 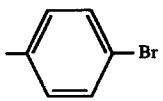 | 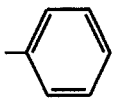 | 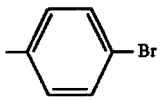 | 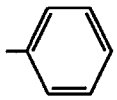 | 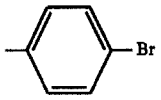 | 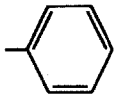 | H | H | H | H | H | H |
| 34 | 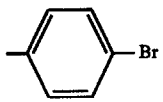 | 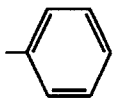 | 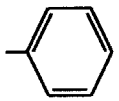 | 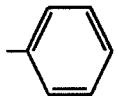 | 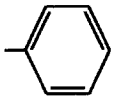 | 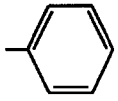 | H | H | H | H | H | H |
| 35 | 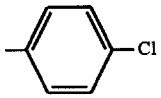 | 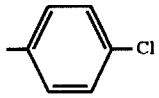 | 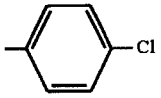 | 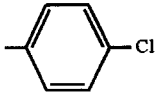 | 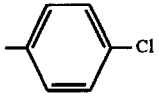 | 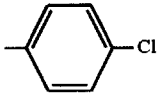 | H | $CH_3$ | H | $CH_3$ | H | $CH_3$ |
| 36 | 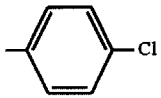 | 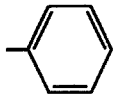 | 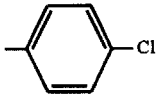 | 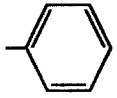 | 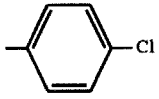 | 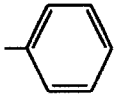 | H | $CH_3$ | H | $CH_3$ | H | $CH_3$ |
| 37 | 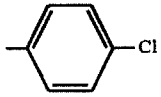 | 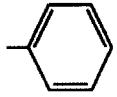 | 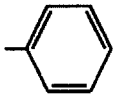 | 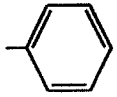 | 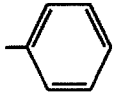 | 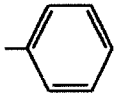 | H | $CH_3$ | H | $CH_3$ | H | $CH_3$ |
| 38 | 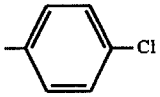 | 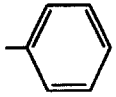 | 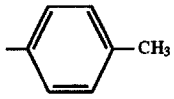 | 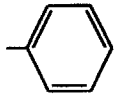 | 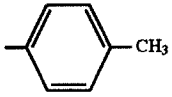 | 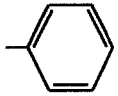 | H | $CH_3$ | H | $CH_3$ | H | $CH_3$ |
| 39 | 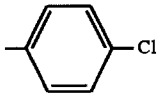 | 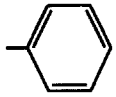 | 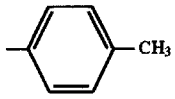 | 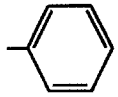 | 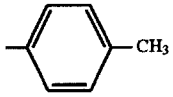 | 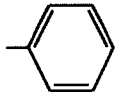 | H | $CH_3$ | H | $CH_3$ | H | $CH_3$ |
| 40 | 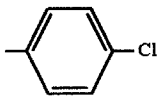 | 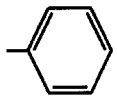 | 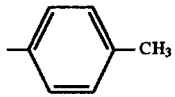 | 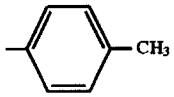 | 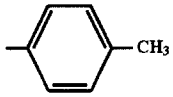 | 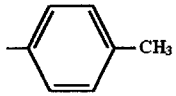 | H | $CH_3$ | H | $CH_3$ | H | $CH_3$ |

TABLE 6
| COMPOUND NO. | $Ar^1$ | $Ar^2$ | $Ar^3$ | $Ar^4$ | $Ar^5$ | $Ar^6$ | $R^1$ | $R^2$ | $R^3$ | $R^4$ | $R^5$ | $R^6$ |
|---|---|---|---|---|---|---|---|---|---|---|---|---|
| 41 | 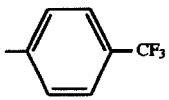 | 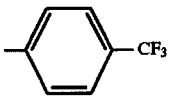 | 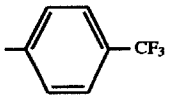 | 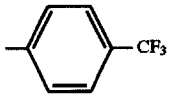 | 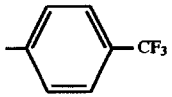 | 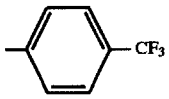 | H | H | H | H | H | H |
| 42 | 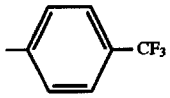 | 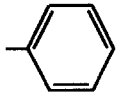 | 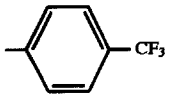 | 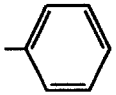 | 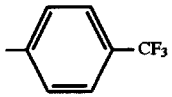 | 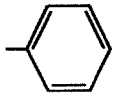 | H | H | H | H | H | H |
| 43 | 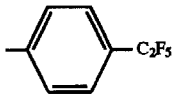 | 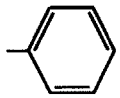 | 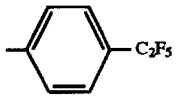 | 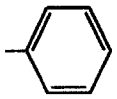 | 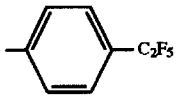 | 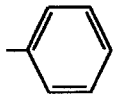 | H | H | H | H | H | H |
| 44 | 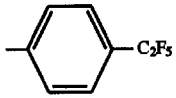 | 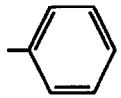 | 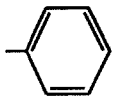 | 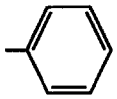 | 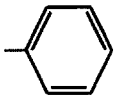 | 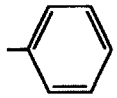 | H | H | H | H | H | H |
| 45 | 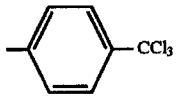 | 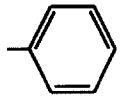 | 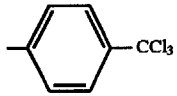 | 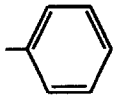 | 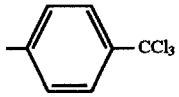 | 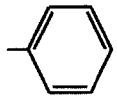 | H | H | H | H | H | H |
| 46 | 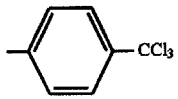 | 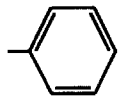 | 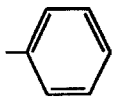 | 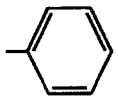 | 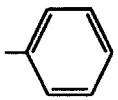 | 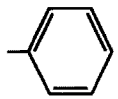 | H | H | H | H | H | H |
| 47 | 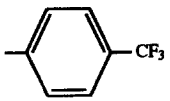 | 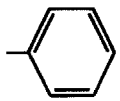 | 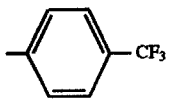 | 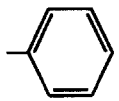 | 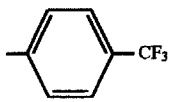 | 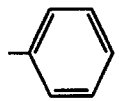 | H | $CH_3$ | H | $CH_3$ | H | $CH_3$ |
| 48 | 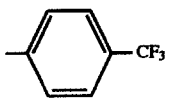 | 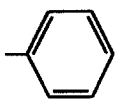 | 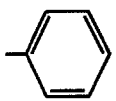 | 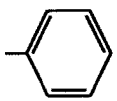 | 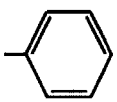 | 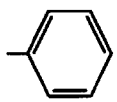 | H | $CH_3$ | H | $CH_3$ | H | $CH_3$ |

TABLE 7
| COMPOUND NO. | $Ar^7$ | $Ar^8$ | $Ar^9$ | $Ar^{10}$ | $R^7$ | $R^8$ | $R^9$ | $R^{10}$ | $R^{11}$ | $R^{12}$ | $R^{13}$ | $R^{14}$ | $R^{15}$ |
|---|---|---|---|---|---|---|---|---|---|---|---|---|---|
| 49 | 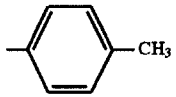 | 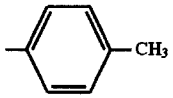 | 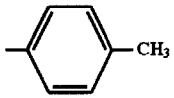 | 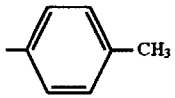 | H | H | H | H | H | H | H | H | H |
| 50 | 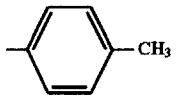 | 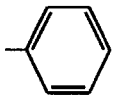 | 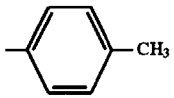 | 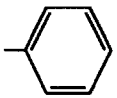 | H | H | H | H | H | H | H | H | H |
| 51 | 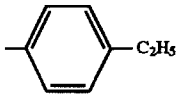 | 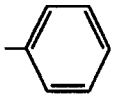 | 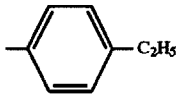 | 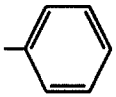 | H | H | H | H | H | H | H | H | H |
| 52 | 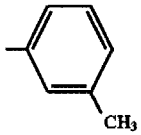 | 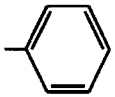 | 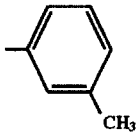 | 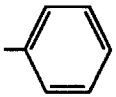 | H | H | H | H | H | H | H | H | H |
| 53 | 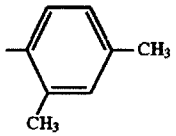 | 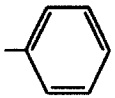 | 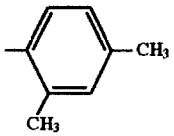 | 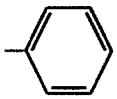 | H | H | H | H | H | H | H | H | H |
| 54 | 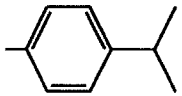 | 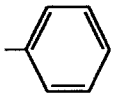 | 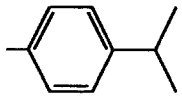 | 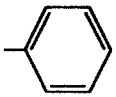 | H | H | H | H | H | H | H | H | H |
| 55 | 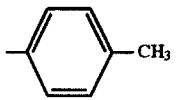 | 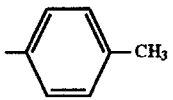 | 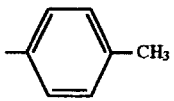 | 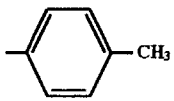 | H | $CH_3$ | H | $CH_3$ | H | H | H | H | H |
| 56 | 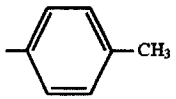 | 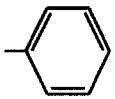 | 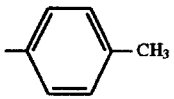 | 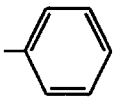 | H | $CH_3$ | H | $CH_3$ | H | H | H | H | H |

TABLE 8
| COMPOUND NO. | $Ar^7$ | $Ar^8$ | $Ar^9$ | $Ar^{10}$ | $R^7$ | $R^8$ | $R^9$ | $R^{10}$ | $R^{11}$ | $R^{12}$ | $R^{13}$ | $R^{14}$ | $R^{15}$ |
|---|---|---|---|---|---|---|---|---|---|---|---|---|---|
| 57 | 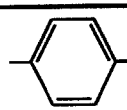 | 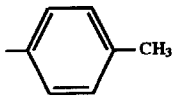 | 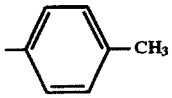 | 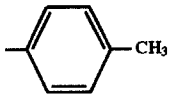 | H | H | H | H | H | H | $CH_3$ | H | H |
| 58 | 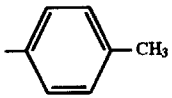 | 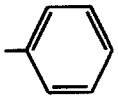 | 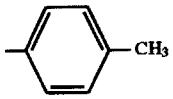 | 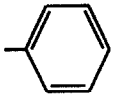 | H | H | H | H | H | $CH_3$ | H | H | H |
| 59 | 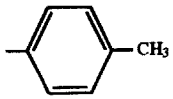 | 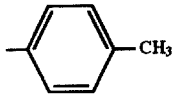 | 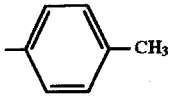 | 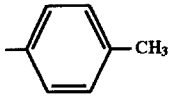 | H | H | H | H | H | H | Ph | H | H |
| 60 | 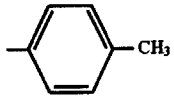 | 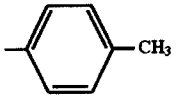 | 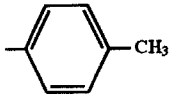 | 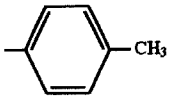 | H | H | H | H | H | H | $CH_2Ph$ | H | H |
| 61 | 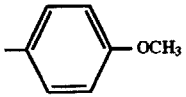 | 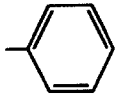 | 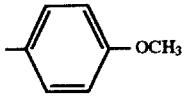 | 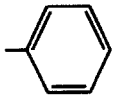 | H | H | H | H | H | H | H | H | H |
| 62 | 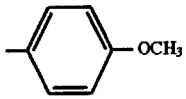 | 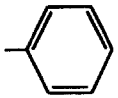 | 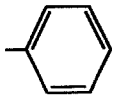 | 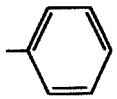 | H | H | H | H | H | H | H | H | H |
| 63 | 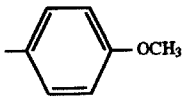 | 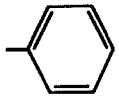 | 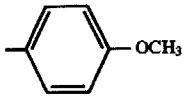 | 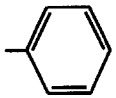 | H | $CH_3$ | H | $CH_3$ | H | H | H | H | H |
| 64 | 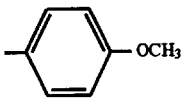 | 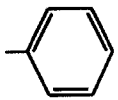 | 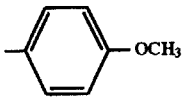 | 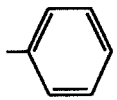 | H | H | H | H | H | H | $CH_3$ | H | H |

TABLE 9
| COMPOUND NO. | $Ar^7$ | $Ar^8$ | $Ar^9$ | $Ar^{10}$ | $R^7$ | $R^8$ | $R^9$ | $R^{10}$ | $R^{11}$ | $R^{12}$ | $R^{13}$ | $R^{14}$ | $R^{15}$ |
|---|---|---|---|---|---|---|---|---|---|---|---|---|---|
| 65 | 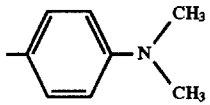 | 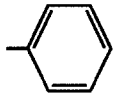 | 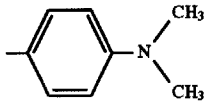 | 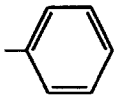 | H | H | H | H | H | H | H | H | H |
| 66 | 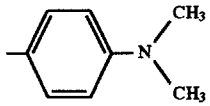 | 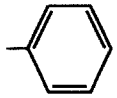 | 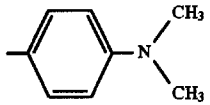 | 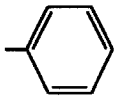 | H | H | H | H | H | H | $CH_3$ | H | H |
| 67 | 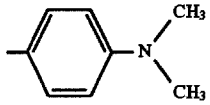 | 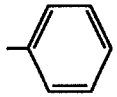 | 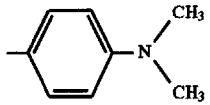 | 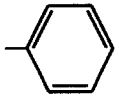 | H | $CH_3$ | H | $CH_3$ | H | H | H | H | H |
| 68 | 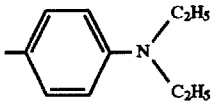 | 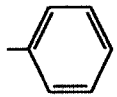 | 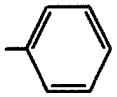 | 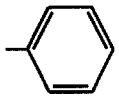 | H | H | H | H | H | H | H | H | H |
| 69 | 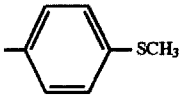 | 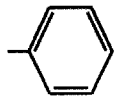 | 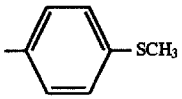 | 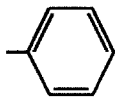 | H | H | H | H | H | H | H | H | H |
| 70 | 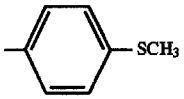 | 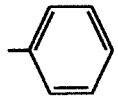 | 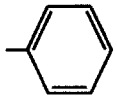 | 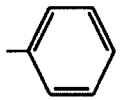 | H | H | H | H | H | H | H | H | H |
| 71 | 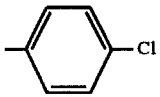 | 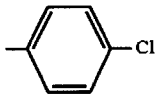 | 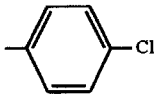 | 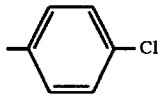 | H | H | H | H | H | H | H | H | H |
| 72 | 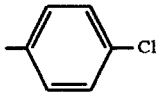 | 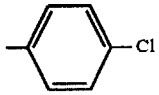 | 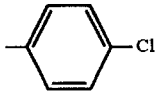 | 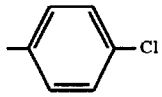 | H | $CH_3$ | H | $CH_3$ | H | H | H | H | H |

TABLE 10
| COMPOUND NO. | $Ar^7$ | $Ar^8$ | $Ar^9$ | $Ar^{10}$ | $R^7$ | $R^8$ | $R^9$ | $R^{10}$ | $R^{11}$ | $R^{12}$ | $R^{13}$ | $R^{14}$ | $R^{15}$ |
|---|---|---|---|---|---|---|---|---|---|---|---|---|---|
| 73 | 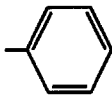 | 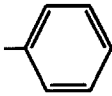 | 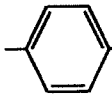 | 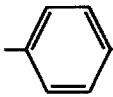 | H | H | H | H | H | H | $CH_3$ | H | H |
| 74 | 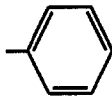 | 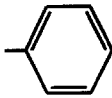 | 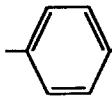 | 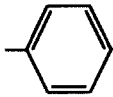 | H | H | H | H | H | H | Ph | H | H |
| 75 | 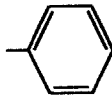 | 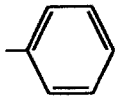 | 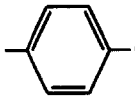 | 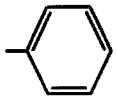 | H | H | H | H | H | H | H | H | H |
| 76 | 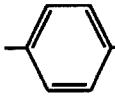 | 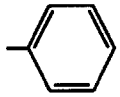 | 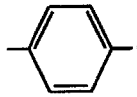 | 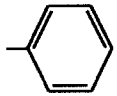 | H | H | H | H | H | H | H | H | H |
| 77 | 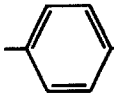 | 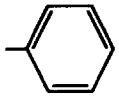 | 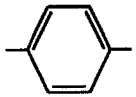 | 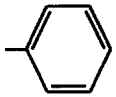 | H | $CH_3$ | H | $CH_3$ | H | H | H | H | H |
| 78 | 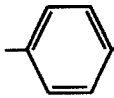 | 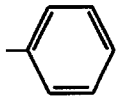 | 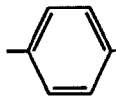 | 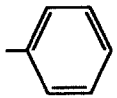 | H | H | H | H | H | H | $CH_3$ | H | H |
| 79 | 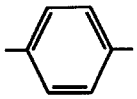 | 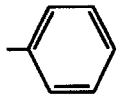 | 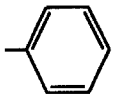 | 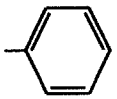 | H | H | H | H | H | H | H | H | H |
| 80 | 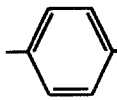 | 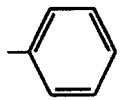 | 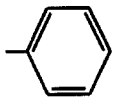 | 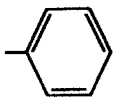 | H | H | H | H | H | H | $CH_3$ | H | H |

The present invention will next be described by way of examples, which should not be construed as limiting the invention.

EXAMPLE 1

An undercoat layer (thickness: 0.1 microns) of methoxy methylated nylon (T-8, manufactured by Unitika, Ltd.) was formed on an aluminum substrate. A charge-generation layer (thickness: 0.1 microns) containing n-type titanyl phthalocyanine and polyvinyl butyral (BX-1, manufactured by Sekisui Chemical Co., Ltd.) was formed on the undercoat layer. Further, the charge-generation layer was coated with a dichloroethane solution which contained Compound 1 shown in Table 1 and polycarbonate (UPYRON Z-200, manufactured by Mitsubishi Gas Chemical Company, Inc.) at the weight ratio 0.8:1, followed by drying at a temperature of 90 C. for 60 minutes to thereby form a charge-transport layer having a thickness of 20 microns. The thus-formed film had good coating properties as well as a sufficient strength. The film was evaluated for electrophotographic characteristics in the following manner through use of an electrostatic recording test apparatus (EPA-8100), manufactured by Kawaguchi Denki Co., Ltd. Briefly, after the film was charged with electricity by corona discharge at −6 kV, the film was dark-decayed for 3 seconds and then irradiated with white light of 5 lux to thereby obtain a length of time (sec) which elapsed until a surface potential was halved. From this measurement, a half decay exposure ($E_{1/2}$, lux.sec) was obtained.

Also, a residual surface potential (−Vr, volt) after irradiation with white light for 5 seconds was measured. The results of this measurement are shown in Table 11. Half decay exposure ($E_{1/2}$) measurements shown in Table 11 are smaller than those of photoreceptors of Comparative Examples 1 to 3, which will be described later. This indicates that Example 1 is superior in photosensitivity to Comparative Examples. Measurements after 1000 times of irradiation with white light are substantially similar to initial measurements, indicating excellent stability upon repeated use.

TABLE 11

| | | Initial measurements | | Measurements after 1000 irradiations | |
|---|---|---|---|---|---|
| | Compound No. | E½ (Lux · sec) | −Vr (V) | E½ (Lux · sec) | −Vr (V) |
| Example 1 | 1 | 0.239 | −4 | 0.240 | −5 |

EXAMPLES 2 TO 25

Photoreceptors were manufactured in a manner similar to that in Example 1 through use of compounds shown in Table 12 below in place of Compound 1 used in Example 1. The thus-manufactured photoreceptors underwent measurement in a manner similar to that in Example 1. All of these photoreceptors showed half decay exposure smaller than that of Comparative Examples. This indicates that Examples 2 to 25 are superior in photosensitivity to Comparative Examples. Measurements after 1000 times of irradiation with white light are substantially similar to initial measurements, indicating excellent stability upon repeated use. As seen from measurements in Examples 23 to 25, even when compounds of the present invention were used in the form of a mixture, excellent photosensitivity and excellent stability upon repeated use also resulted.

TABLE 12

| | COMPOUND | INITIAL MEASUREMENTS | | MEASUREMENTS AFTER 1000 IRRADIATIONS | |
|---|---|---|---|---|---|
| | NO. | $E_{1/2}$ | −Vr | $E_{1/2}$ | −Vr |
| EXAMPLE 2 | 2 | 0.295 | −1 | 0.301 | −3 |
| EXAMPLE 3 | 5 | 0.301 | −2 | 0.310 | −4 |
| EXAMPLE 4 | 7 | 0.288 | −6 | 0.292 | −9 |
| EXAMPLE 5 | 8 | 0.241 | −5 | 0.251 | −5 |
| EXAMPLE 6 | 9 | 0.325 | −4 | 0.334 | −5 |
| EXAMPLE 7 | 11 | 0.263 | −4 | 0.282 | −7 |
| EXAMPLE 8 | 14 | 0.308 | −2 | 0.315 | −5 |
| EXAMPLE 9 | 19 | 0.309 | −2 | 0.311 | −4 |
| EXAMPLE 10 | 25 | 0.255 | −1 | 0.266 | −2 |
| EXAMPLE 11 | 30 | 0.310 | −3 | 0.317 | −4 |
| EXAMPLE 12 | 36 | 0.265 | −5 | 0.267 | −5 |
| EXAMPLE 13 | 42 | 0.323 | −7 | 0.340 | −9 |
| EXAMPLE 14 | 47 | 0.275 | −4 | 0.288 | −5 |
| EXAMPLE 15 | 48 | 0.341 | −3 | 0.350 | −6 |
| EXAMPLE 16 | 49 | 0.299 | −3 | 0.306 | −6 |
| EXAMPLE 17 | 50 | 0.292 | −2 | 0.298 | −5 |
| EXAMPLE 18 | 55 | 0.310 | −4 | 0.320 | −6 |
| EXAMPLE 19 | 57 | 0.306 | −1 | 0.312 | −3 |
| EXAMPLE 20 | 64 | 0.286 | −2 | 0.292 | −6 |
| EXAMPLE 21 | 71 | 0.301 | −3 | 0.304 | −5 |
| EXAMPLE 22 | 78 | 0.289 | −5 | 0.299 | −7 |
| EXAMPLE 23 | 1/49 = 50/50 | 0.297 | −1 | 0.303 | −7 |
| EXAMPLE 24 | 1/57 = 60/40 | 0.307 | −1 | 0.320 | −4 |
| EXAMPLE 25 | 9/64 = 50/50 | 0.299 | −3 | 0.310 | −6 |

COMPARATIVE EXAMPLES 1 TO 3

Photoreceptors were manufactured in a manner similar to that in Example 1 through use of compounds represented by formulas (101) to (103) below as charge-transport materials. The thus-manufactured photoreceptors underwent measurement in a manner similar to that in Example 1. The results of this measurement are shown in Table 13.

(101)

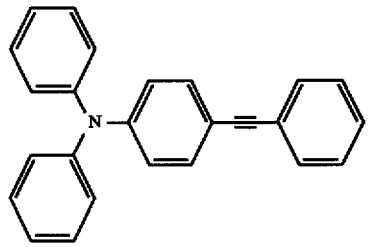

(102)

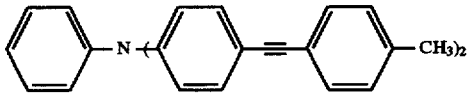

(103)

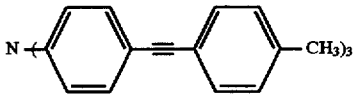

TABLE 13

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Comparative Example 1 | 101 | 0.501 | −4 | 0.552 | −5 |
| Comparative Example 2 | 102 | 0.456 | −2 | 0.463 | −6 |
| Comparative Example 3 | 103 | 0.375 | −3 | 0.391 | −8 |

EXAMPLE 26

An undercoat layer (thickness: 0.1 microns) of a polyamide resin (A-70, manufactured by Toray Corp.) was formed on a conductive support member having a structure in which aluminum was vapor-deposed on a polyester film. A charge-generation layer (thickness: 0.1 microns) containing τ-type metal-free phthalocyanine and a butyral resin (DENKA BUTYRAL #3000, manufactured by Denki Kagaku Kogyo Co., Ltd.) was formed on the undercoat layer. Compound 1 shown in Table 11 was used as a charge-transport material. An oxidation inhibitor (IRGANOX 1010, manufactured by Ciba-Geigy (Japan), Ltd.) was added in an amount of 1.5 wt. % of the charge-transport material. A photoreceptor was thus prepared in a manner similar to that in Example 1. The thus-prepared photoreceptor underwent measurement in a manner similar to that in Example 1. The results of this measurement are shown in Table 14. Because of use of the conductive support member having a structure in which aluminum was vapor-deposited on a polyester film, the photoconductive product of Example 26 is slightly inferior in photosensitivity to those of Examples 1 to 25. However, the photoconductive product of Example 26 is still superior in photosensitivity to that of Comparative Example 4.

TABLE 14

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Example 26 | 1 | 0.720 | −6 | 0.751 | −8 |

EXAMPLES 27 to 45

Photoreceptors were manufactured in a manner similar to that in Example 26 through use of compounds shown below in Table 15 in place of Compound 1 used in Example 26. The thus-manufactured photoreceptors underwent measurement in a manner similar to that in Example 26. Measurements indicate that all of these photoreceptors of Examples 27 through 45 are superior to the photoconductive product of Comparative Example 4 in terms of photosensitivity and stability upon repeated use.

TABLE 15

| | COMPOUND | INITIAL MEASUREMENTS $E_{1/2}$ | INITIAL MEASUREMENTS −Vr | MEASUREMENTS AFTER 1000 IRRADIATION $E_{1/2}$ | MEASUREMENTS AFTER 1000 IRRADIATION −Vr |
|---|---|---|---|---|---|
| EXAMPLE 27 | 2 | 0.852 | −8 | 0.865 | −12 |
| EXAMPLE 28 | 5 | 0.799 | −7 | 0.907 | −10 |
| EXAMPLE 29 | 7 | 0.921 | −6 | 1.009 | −9 |
| EXAMPLE 30 | 8 | 0.867 | −5 | 0.991 | −5 |
| EXAMPLE 31 | 9 | 1.025 | −10 | 1.132 | −10 |
| EXAMPLE 32 | 10 | 0.877 | −7 | 0.922 | −9 |
| EXAMPLE 33 | 15 | 0.979 | −4 | 1.103 | −5 |
| EXAMPLE 34 | 19 | 0.765 | −5 | 0.804 | −5 |
| EXAMPLE 35 | 26 | 0.769 | −2 | 0.851 | −4 |
| EXAMPLE 36 | 30 | 0.993 | −8 | 1.006 | −10 |
| EXAMPLE 37 | 36 | 0.883 | −10 | 0.904 | −11 |
| EXAMPLE 38 | 39 | 1.003 | −11 | 1.019 | −14 |
| EXAMPLE 39 | 42 | 0.915 | −6 | 0.917 | −9 |
| EXAMPLE 40 | 48 | 1.101 | −6 | 1.145 | −8 |
| EXAMPLE 41 | 49 | 0.923 | −5 | 0.941 | −8 |
| EXAMPLE 42 | 50 | 0.892 | −4 | 0.904 | −9 |
| EXAMPLE 43 | 57 | 0.826 | −5 | 0.840 | −7 |
| EXAMPLE 44 | 1/49 = 50/50 | 0.873 | −3 | 0.891 | −5 |
| EXAMPLE 45 | 9/64 = 50/50 | 0.810 | −3 | 0.817 | −6 |

COMPARATIVE EXAMPLE 4

A photoconductive product was manufactured in a manner similar to that in Example 26 except that Compound 6 represented by formula 104 shown below was used as a charge-transport material. Table 16 shows the measurements of the resultant photoconductive product.

(104)

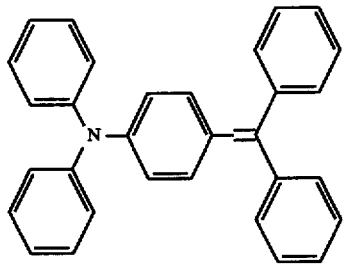

TABLE 16

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Comparative Example 4 | 6 | 4.0 | −10 | 5.0 | −30 |

EXAMPLE 46

A photoconductive product was manufactured in a manner similar to that in Example 1. A charge-generation layer (thickness: 0.1 microns) containing n-type titanyl phthalocyanine and polyvinyl butyral (BX-1, manufactured by Sekisui Chemical Co., Ltd.) was formed on an alumite-treated aluminum substrate. Further, the charge-generation layer was coated with a dichloroethane solution which contained Compound 1 shown in Table 1 and polycarbonate (UPYRON Z-200, manufactured by Mitsubishi Gas Chemical Company, Inc.) at the weight ratio 0.8:1. The thus-manufactured photoconductive product underwent measurement in a manner similar to that in Example 1. The results of this measurement are shown in Table 17. As seen from Table 17, the photoconductive product of Example 46 is superior to photoconductive products of Comparative Examples 5 to 7 in terms of photosensitivity and stability upon repeated use.

TABLE 17

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Example 46 | 31 | 0.210 | −2 | 0.212 | −4 |

EXAMPLES 47–60

Photoreceptors were manufactured in a manner similar to that in Example 46 through use of compounds shown below in Table 18 in place of Compound 31 used in Example 46. The thus-manufactured photoreceptors underwent measurement in a manner similar to that in Example 46. Measurements indicate that all of these photoreceptors of Examples 47 to 60 are superior to the photoconductive products of Comparative Examples 5 to 7 in terms of photosensitivity and stability upon repeated use.

TABLE 18

| | COMPOUND NO. | INITIAL MEASUREMENTS $E_{1/2}$ | INITIAL MEASUREMENTS −Vr | MEASUREMENTS AFTER 1000 IRRADIATIONS $E_{1/2}$ | MEASUREMENTS AFTER 1000 IRRADIATIONS −Vr |
|---|---|---|---|---|---|
| EXAMPLE 47 | 2 | 0.243 | −1 | 0.250 | −2 |
| EXAMPLE 48 | 7 | 0.233 | −1 | 0.236 | −1 |
| EXAMPLE 49 | 8 | 0.228 | −2 | 0.229 | −4 |
| EXAMPLE 50 | 9 | 0.265 | −4 | 0.269 | −5 |
| EXAMPLE 51 | 11 | 0.251 | −3 | 0.251 | −4 |
| EXAMPLE 52 | 14 | 0.237 | −1 | 0.238 | −1 |
| EXAMPLE 53 | 15 | 0.269 | −4 | 0.275 | −5 |
| EXAMPLE 54 | 29 | 0.250 | −3 | 0.261 | −3 |
| EXAMPLE 55 | 42 | 0.245 | −2 | 0.247 | −2 |
| EXAMPLE 56 | 50 | 0.253 | −1 | 0.261 | −2 |
| EXAMPLE 57 | 57 | 0.239 | −2 | 0.247 | −4 |
| EXAMPLE 58 | 64 | 0.244 | −4 | 0.252 | −5 |
| EXAMPLE 59 | 1/50 = 50/50 | 0.230 | −1 | 0.244 | −2 |
| EXAMPLE 60 | 2/64 = 70/30 | 0.229 | −2 | 0.232 | −3 |

COMPARATIVE EXAMPLES 5 TO 7

Photoreceptors were manufactured in a manner similar to that in Example 46 through use of compounds used in Comparative Examples 1 to 3 as charge-transport materials. The thus-manufactured photoreceptors underwent measurement in a manner similar to that in Example 46. The results of this measurement are shown in Table 19.

TABLE 19

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Comparative Example 5 | 101 | 0.414 | −8 | 0.461 | −9 |
| Comparative Example 6 | 102 | 0.382 | −6 | 0.399 | −7 |
| Comparative Example 7 | 103 | 0.289 | −5 | 0.301 | −5 |

EXAMPLES 61 AND 62

Photoreceptors were manufactured in a manner similar to that in Example 1 except that Compound 1 and polycarbonate were contained at weight ratios of 0.6:1 (Example 61) and 0.4:1 (Example 62). The thus-manufactured photoreceptors underwent measurement in a manner similar to that in Example 1. The results of this measurement are shown in Table 20. Compound 1 exhibited a remarkable photosensitivity in the photoreceptor at the weight ratio of 0.4:1.

TABLE 20

| | Compound No. | Initial measurements E½ (Lux · sec) | Initial measurements −Vr (V) | Measurements after 1000 irradiations E½ (Lux · sec) | Measurements after 1000 irradiations −Vr (V) |
|---|---|---|---|---|---|
| Example 61 | 1 | 0.351 | −6 | 0.322 | −8 |
| Example 62 | 1 | 0.381 | −8 | 0.392 | −12 |

As described above, the photoreceptor for electrophotography of the present invention has excellent photosensitive properties, and exhibits reduced levels of residual potential and dark-decay. Moreover, the product of the invention exhibits excellent stability upon repeated use due to its reduced photofatigue properties.

Although the present invention is described with reference to preferred embodiments thereof, the present invention is not limited thereto and it will be apparent from those skilled in the art that various modifications or alterations can be easily made without departing from the scope of the present invention as set forth in the appended claims.

What is claimed is:

1. A photoreceptor for electrophotography comprising a first layer comprising:

(A) a charge-generating material;

(B) a charge-transport material, wherein said charge-transport material is at least one of the compounds represented by the following formula (1):

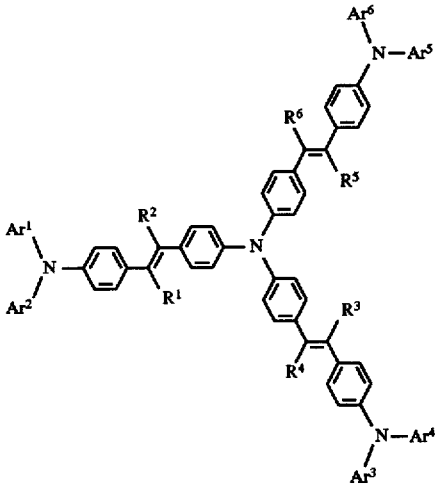

(1)

wherein each of $Ar^1$ through $Ar^6$ is a phenyl group which may or may not have one or more substituents which may be identical to or different from one another, and the substituent on any of the groups $Ar^1$ through $Ar^6$ is a group or an atom selected from the group consisting of C1–C4 alkyl, C1–C4 alkoxy, C1–C4 alkylamino, C1–C4 dialkylamino, C1–C4 alkylthio, C1–C4 halogenoalkyl, amino, and a halogen atom; and each of $R^1$ through $R^6$ is a member selected from a group comprised of a hydrogen atom and a methyl group.

2. A photoreceptor for electrophotography, comprising:

(A) a first layer comprising a charge transport material, wherein said charge transport material is at least one of the compounds represented by the following formula (1):

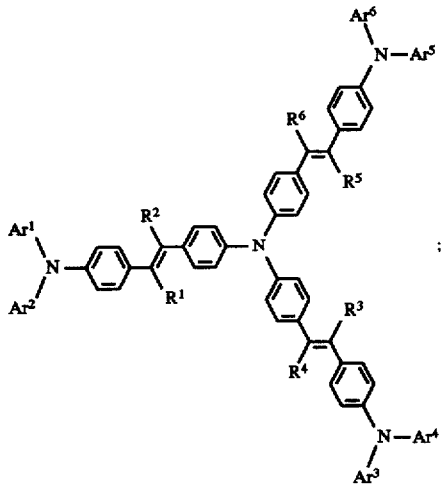

(1)

;

and (B) a second layer comprising a charge generating material.

3. A photoreceptor according to claim 1 or 2, wherein said first layer contains said at least one of the compounds represented by formula (1) in an amount from 20 to 70% by weight.

4. A photoreceptor for electrophotography comprising a first layer comprising:

(A) a charge-generating material;

(B) a charge-transport material, wherein said charge-transport material is at least one of the compounds represented by the following formula (2):

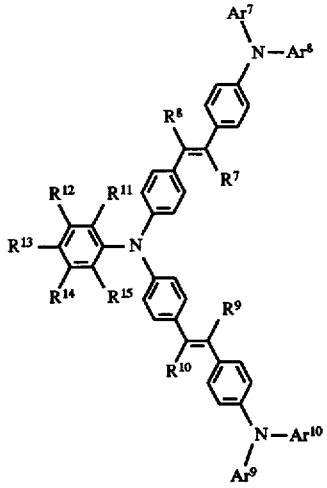

(2)

wherein each of $Ar^7$ through $Ar^{10}$ is a phenyl group which may or may not have one or more substituents which may be identical to or different from one another, and the substituent on any of the groups $Ar^7$ through $Ar^{10}$ is a group or an atom selected from the group consisting of C1–C4 alkyl, C1–C4 alkoxy, C1–C4 alkylamino, C1–C4 dialkylamino, C1–C4 alkylthio, C1–C4 halogenoalkyl, amino, and a halogen atom; and each of $R^7$ through $R^{10}$ is a member selected from a group comprised of a hydrogen atom and a methyl group, and each of $R^{11}$ through $R^{15}$, which may be identical to or different from one another, is a member selected from a group comprised of a hydrogen atom, a C1–C4 alkyl group, a C6–C14 aryl group, and a C7–C14 aralkyl group.

5. A photoreceptor for electrophotography, comprising:

(A) a first layer comprising a charge transport material, wherein said charge transport material is at least one of the compounds represented by the following formula (1):

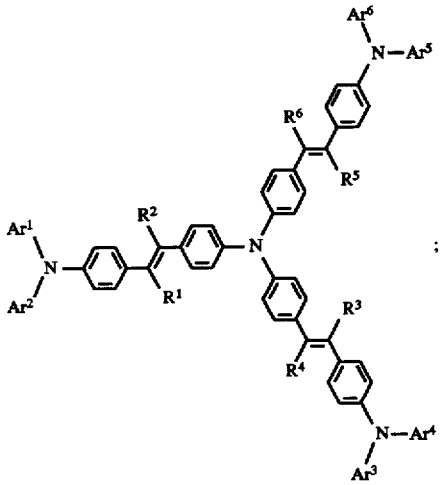

(1)

;

and (B) a second layer comprising a charge generating material.

6. A photoreceptor according to claim 4 or 5, wherein said first layer contains said at least one of the compounds represented by formula (2) in an amount from 20 to 70% by weight.

7. A photoreceptor according to claim 4, wherein said first layer contains, in addition to said at least one of the compounds represented by formula (2), at least one of the compounds represented by the formula (1):

(1)

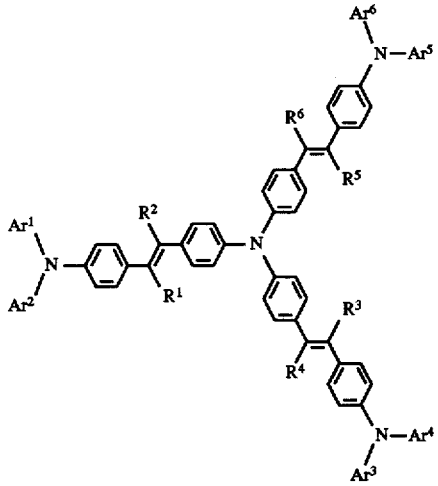

-continued (2)

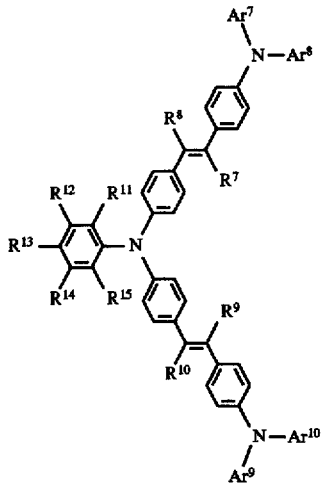

wherein each of $Ar^1$ through $Ar^6$ is a phenyl group which may or may not have one or more substituents which may be identical to or different from one another, and the substituent on any of the groups $Ar^1$ through $Ar^6$ is a group or an atom selected from the group consisting of C1–C4 alkyl, C1–C4 alkoxy, C1–C4 alkylamino, C1–C4 dialkylamino, C1–C4 alkylthio, C1–C4 halogenoalkyl, amino, and a halogen atom; and each of $R^1$ through $R^6$ is a member selected from a group comprised of a hydrogen atom and a methyl group.

8. A photoreceptor for electrophotography according to claim 7, wherein said first layer contains said at least one of the compounds represented by formula (2) and said at least one of the compound represented by formula (1) in an amount from 20 to 70% by weight.

* * * * *

UNITED STATES PATENT AND TRADEMARK OFFICE

CERTIFICATE OF CORRECTION

PATENT NO. : 5,733,697
DATED : March 31, 1998
INVENTOR(S) : Endoh

It is certified that error appears in the above-indentified patent and that said Letters Patent is hereby corrected as shown below:

Column 33, line 43, Table 18, delete "0.265" and insert --0.266--;

Column 34, line 37, Table 20, delete "0.351" and insert --0.315--.

Signed and Sealed this

Fourteenth Day of July, 1998

Bruce Lehman

*Attest:*

BRUCE LEHMAN

*Attesting Officer*

*Commissioner of Patents and Trademarks*